US005408069A

United States Patent [19]

Mischel, Jr.

[11] Patent Number: 5,408,069

[45] Date of Patent: Apr. 18, 1995

[54] SELF-DEFOGGING MIRROR

[76] Inventor: James V. Mischel, Jr., 5968 - 101 Jake Sears Cir., Virginia Beach, Va. 23464

[21] Appl. No.: 128,824

[22] Filed: Sep. 28, 1993

[51] Int. Cl.[6] ..... H05B 3/28

[52] U.S. Cl. ..... 219/219; 219/213

[58] Field of Search ..... 219/219, 213, 522, 543, 219/528, 548, 549; 392/438, 439, 436

[56] References Cited

U.S. PATENT DOCUMENTS

| | | | |
|---|---|---|---|
| 2,564,836 | 8/1951 | Elsenheimer | 219/219 |
| 2,623,971 | 12/1952 | Glynn . | |
| 3,454,746 | 7/1969 | Dubois | 219/549 |
| 3,597,586 | 8/1971 | Rebovich | 219/219 |
| 3,790,748 | 2/1974 | Van Laethem et al. | 219/219 |
| 3,800,121 | 3/1974 | Dean | 219/543 |
| 3,887,788 | 6/1975 | Seibel et al. | 219/219 |
| 4,071,736 | 1/1978 | Kamerling | 219/219 |
| 4,277,672 | 7/1981 | Jones | 219/497 |
| 4,352,006 | 9/1982 | Zega | 219/219 |
| 4,665,304 | 5/1987 | Spencer | 219/219 |
| 4,701,594 | 10/1987 | Powell | 219/219 |
| 4,839,500 | 6/1989 | Cremer | 219/213 |
| 4,857,711 | 8/1989 | Watts | 219/548 |
| 4,940,317 | 7/1990 | Reuben | 350/588 |
| 4,956,542 | 9/1990 | Prosser | 219/219 |
| 4,967,057 | 10/1990 | Bayless | 219/213 |
| 5,083,009 | 1/1992 | Reiser et al. | 219/219 |

*Primary Examiner*—Teresa J. Walberg
*Attorney, Agent, or Firm*—Todd N. Hathaway

[57] ABSTRACT

A device for heating a mirror so as to prevent the formation of fog thereon. There is a generally planar electric heating element for the back surface of the mirror, and an electrostatic shield which is mountable between the heating element and the reflective coating on the mirror, so as to prevent the development of an electrostatic charge between the element and coating. The electrostatic shield may be provided by a layer of high resistance conductive ink printed on a sheet of insulation; the conductive material is connected to ground potential as provided by the neutral lead of a household AC power supply. The heating element may also be provided by high resistance conductive ink printed on a sheet of insulation, with low resistance ink being printed over this to provide a power distribution/return network.

25 Claims, 6 Drawing Sheets

SELF-DEFOGGING MIRROR

FIELD OF THE INVENTION

The present invention relates generally to mirrors, and more particularly, to an electrical heating assembly for defogging the surface of a mirror.

BACKGROUND OF THE INVENTION

The problem of condensation forming on mirrors which are exposed to warm, humid air—e.g. in a bathroom—has proven to be a long-standing inconvenience. Extractor fans, they most commonly employed "remedy", are of little help.

Raising the temperature of the mirror's surface above the dew point will prevent the formation of condensation, and so would eliminate the problem of fogging. Various devices have been proposed for doing this, but none appears to have achieved any significant degree of commercial success. In many cases, the prior devices have been deficient from the standpoint of economy of manufacture: For example, many of the proposed devices have required a specially manufactured mirror glass, whereas others require that the mirror element be mounted in a complex frame structure or other installation.

U.S. Pat. No. 4,665,304 (Spencer) discloses a defogging device which is perhaps closest in general configuration to the present invention, inasmuch as this utilizes a sheet-like electric heating element which is mounted adjacent to the back side of the mirror. Other known devices resemble a simple radiant heating pad mounted to the back of a mirror. Devices of this general type have many advantages over more complicated and bulky systems, but they tend to deliver a very unpleasant shock when touched on the edge, especially by a person who is standing on a damp floor or leaning against a sink adjacent to the mirror. As will be described below, it is part of the present invention that the applicants have discovered and eliminated the unexpected source of this problem.

Accordingly, there exists a need for a device for heating a mirror so as to remove or prevent condensation of thereon, which device may be used with standard, inexpensive plate mirror stock, which is thin and does not interfere with the ordinary methods of installing the mirrors, which is impervious to moisture, and which is inexpensive to manufacture. Moreover, there exists a need for such a device having a construction which obviates the possibility of imparting a shock when touched.

SUMMARY OF THE INVENTION

The present invention has solved the problems cited above, and is a device for heating a mirror so as to prevent formation of fog thereon.

Broadly, the device comprises a generally planar electric heating element mountable to a back surface of a mirror having a metallic reflective coating, a generally planar electrostatic shield mountable intermediate the electric heating element and the metallic reflective coating, the electrostatic shield comprising a layer of conductive material which extends between the element and the coating, and means for connecting the layer of conductive material in the electrostatic shield to ground potential, so that the shield prevents development of an electrostatic charge between the electric heating element and the reflective coating on the mirror.

Preferably, the layer of conductive material in the electrostatic shield is a layer of relatively high resistance conductive material, and the means for connecting this to ground potential comprises means for connecting of the layer to a neutral lead of a 115 VAC power supply.

Preferably, the electric heating element, in turn, comprises a second layer of relatively high resistance conductive material, and means for applying voltage across this layer so that it becomes heated. The means for applying voltage across the second layer of relatively high resistance conductive material may comprise a layer of relatively low resistance conductive material in contact therewith, the relatively low resistance material being formed into first and second contact strips which are connected to first and second leads of an electrical power source, and which are spaced apart from one another so that the current flows through the layer of high resistance conductive material. Preferably, the first lead is a hot lead of a 115 VAC power source, and the second lead is the neutral lead.

The layer of high resistance conductive material in the electrostatic shield may be a layer of high resistance conductive ink deposited on a first layer of insulating material; similarly, the layer of high resistance conductive material in the heating element may be a layer of high resistance conductive ink deposited on a second layer of insulating material. The layer of low resistance conductive material, in turn, may be a layer of low resistance conductive ink deposited on the layer of high resistance conductive ink.

There may be means for bonding of the heating element to the electrostatic shield so that the layer of conductive material in the shield is sandwiched between the first and second layers of insulating material, and so that a surface of the first layer of insulating material which is free of the conductive material is mountable to the rearward surface of the mirror. There may also be a back cover of insulating material which is mounted over the layers of low and high resistance conductive material on the second layer of insulation, so that the conductive layers of the heating element are sandwiched between the second layer of insulating material and the back cover of the device.

DETAILED DESCRIPTION a. Overview

Figure 1:
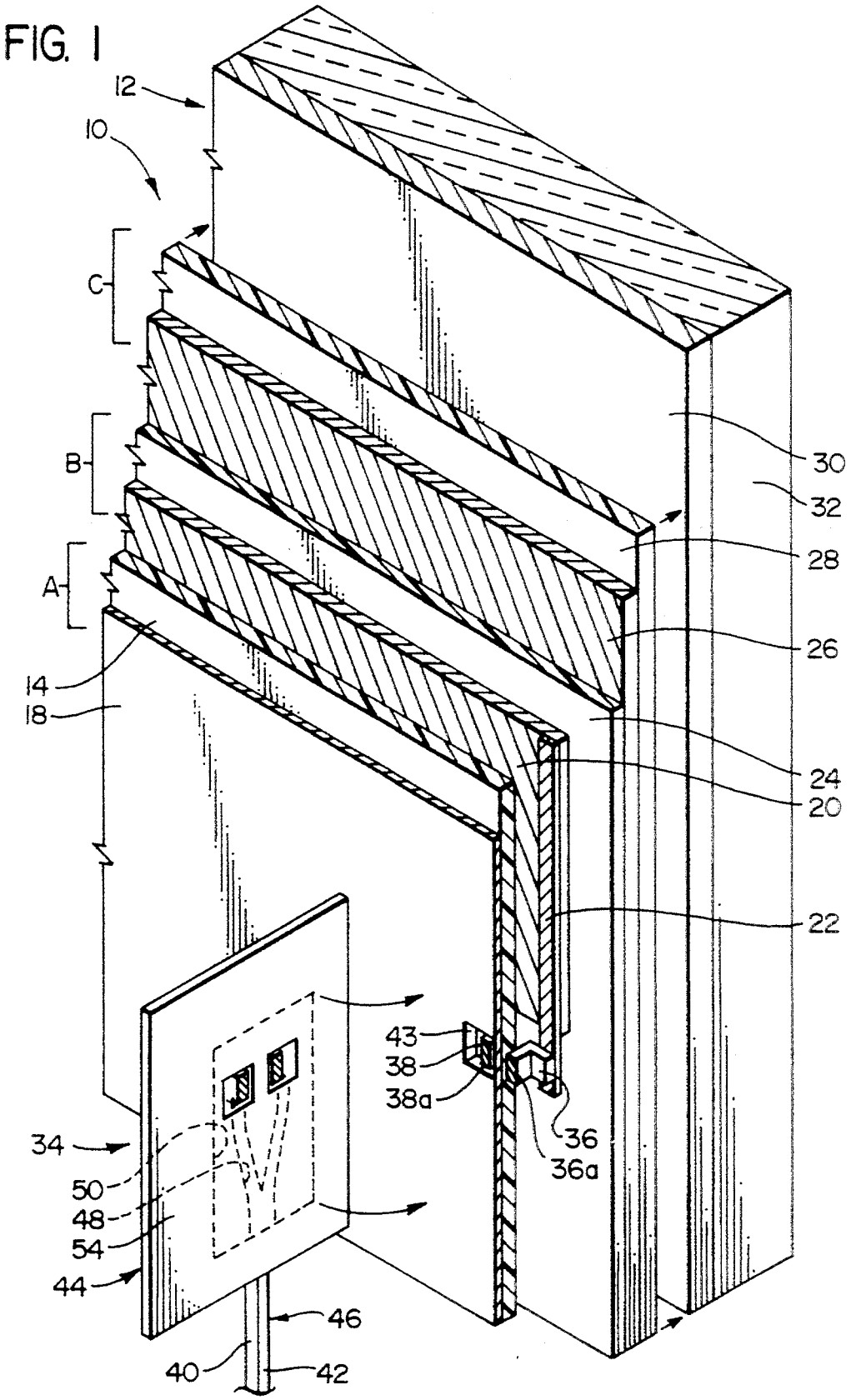
FIG. 1 is a perspective view of a portion of the device of the present invention, and the back of a mirror to which this is mounted, this being shown partly cutaway to reveal the various layers which make up the structure of the device.

As can be seen in FIG. 1, the present invention is configured generally as a flexible, layered pad assembly 10 which is mountable to the back of a mirror 12, so that heat generated by the pad assembly raises the temperature of the mirror's surface above the dew point, removing or preventing the formation of water condensation in the form of fog. Power is supplied to the device by 115 VAC household current, preferably in a Ground Fault Indicator (GFI) circuit.

As indicated in FIG. 1, the layered structure of the pad assembly 10 is made up generally of three subassemblies: A-back cover layer; B-heating element layer; C-electrostatic shield layer. For purposes of illustration, these subassemblies will be discussed individually below; however, it will be understood that in the final product the subassemblies are bonded together to form a unitary pad 10.

The back cover layer (A) serves primarily to seal and insulate the assembly. This is made up generally of a durable, water and chemical resistant back covering 14, preferably formed of polycarbonate or polyester sheeting. To increase the heating efficiency of the pad, a layer or coating of reflective material 18 may be added over the back covering, so as to direct the thermal energy generated by the heating layer back toward the mirror 12.

The main heating layer (B) is provided with a more-or-less continuous layer of relatively high resistance conductive material 20, preferably a screen printable conductive graphite ink. Voltage is applied across the high resistance conductive layer by means of a layer of relatively low resistance conductive material 22, which is formed into first and second, relatively thin conductive strips which form the distribution and return conductors for the supply current. The conductive strips are spaced apart from one another and mounted in conductive relationship with the layer of high resistance conductive material 20; thus, when connected to a power source, the current flows through the high resistance conductive layer, generating the heat which is employed to defog the mirror. As will be described below, the high resistance and low resistance conductive layers are formed on a second sheet of insulation 24, so that the conductive layers are sandwiched between insulation 24 and 14 in the final assembly.

The electrostatic shield layer (C) is positioned between the heating layer and the mirror in the final assembly. The principal component of the electrostatic shield is a second layer 26 of relatively high resistance conductive material. As will be described below, this layer is connected to the neutral lead of the power source, and serves to prevent capacitive coupling from developing between the heating element layer and the silver plating on the back of the mirror. The conductive layer 26 is sandwiched between insulation 24 and a final, inner layer of insulation 28.

A coating of adhesive (not shown) on insulation 28 serves to bond the pad assembly 10 to the back side of the mirror 12. Heat generated by the pad assembly is thus conducted through the reflective plating 30 and into the glass 32 of the conventional mirror stock, heating this so as to remove any fogging.

Power is supplied to the pad assembly 10 by power connector patch 34. This is connected to first and second contacts 36, 38 which, in a conventional household installation, are connected to the 115 VAC and neutral leads 40, 42 of the power supply. The contacts 36, 38 are preferably formed as copper strips which are bonded to the conductive layers of the pad assembly: As will be described below, the 115 VAC contact 36 is connected to a strip portion of layer 22 which provides power distribution to the relatively resistive layer 20, while the neutral contact 38 is connected to a return strip portion of layer 22, and also to the high resistance conductive layer 26 of the electrostatic shield.

The end of the two copper contact strips are bent outwardly to form tabs **36*a*, 38*a* which protrude through openings 43 in the back cover. The contact tabs 36*a*, 38*a* (which, for purposes of illustration, are shown sectioned in FIG. 1) are mounted to the ends of leads 40, 42 within a strain relief 44, which prevents damage to the contacts and mountings in the event that tension is applied to the electrical cord 46. The twoleads 40, 42 are spread apart and received in a Y-shaped channel 48 formed in the inner surface of cap 50, and the contacts are received in separate recesses at the ends of the channel. For additional support, the strain relief cap 50 is mounted more or less centrally in a relatively rigid support panel 54**, which is adhesively mounted to the back covering of the pad assembly.

It should be noted that FIG. 1 is not drawn to scale, and protrusions, relative thicknesses, and so forth are generally exaggerated for purposes of illustration; given the construction described below, the entire pad assembly 10 provides a very thin (e.g., approximately 1/32 inch) and flexible panel which fits unobstrusively between a mirror and a wall in a conventional mounting.

b. Heating Element Layer

Figure 2:
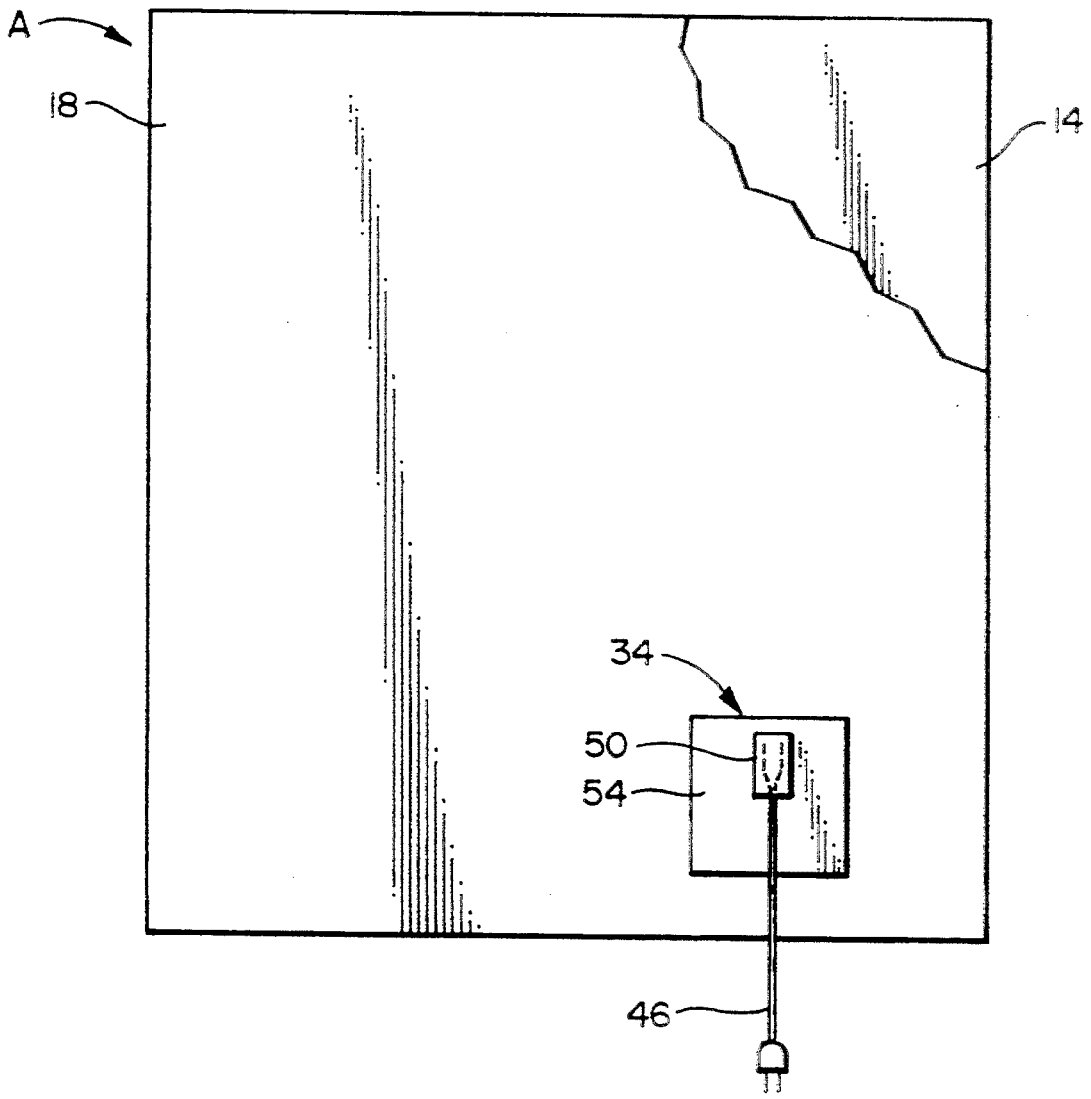
FIG. 2 is an elevational view of the back covering layer of a device similar to that shown in FIG. 1.
Figure 3:
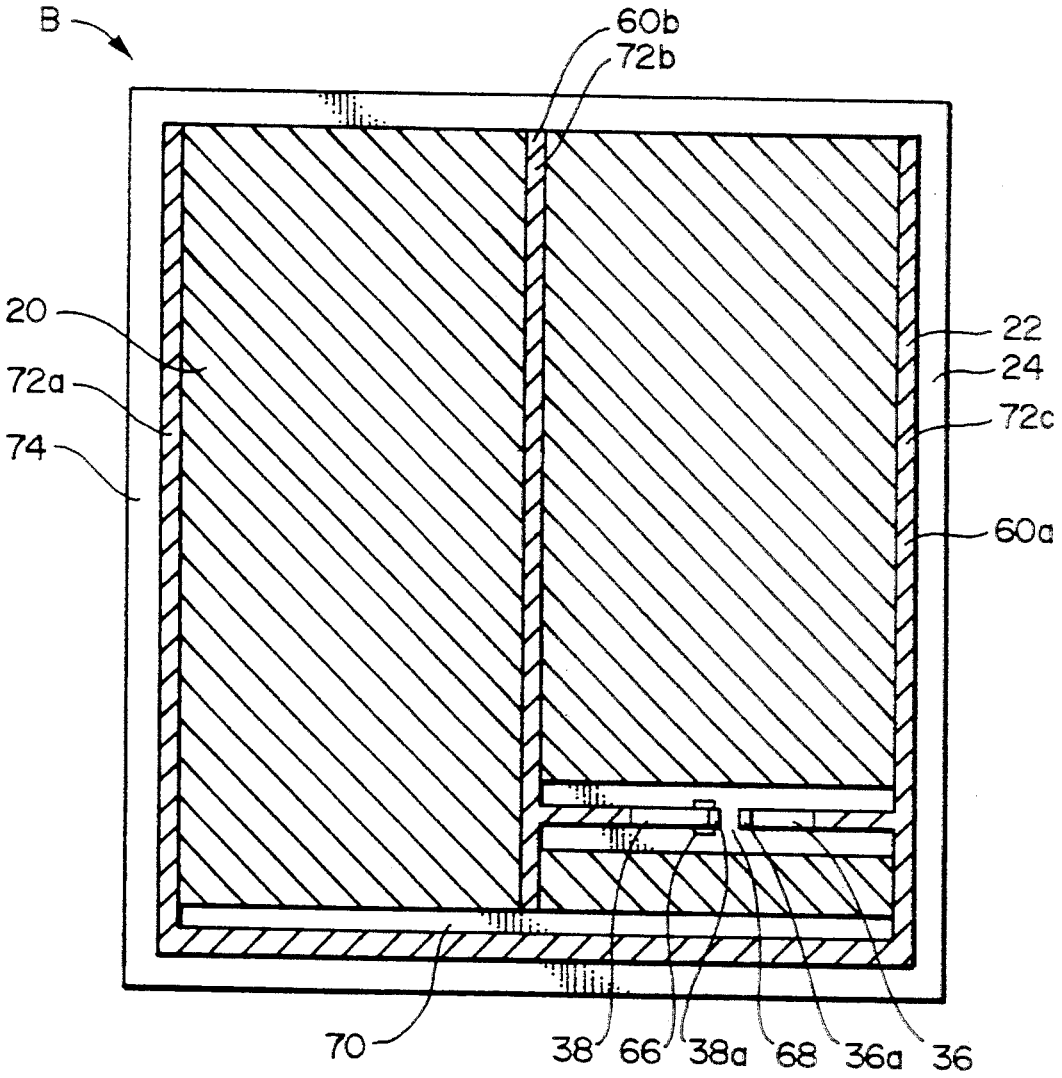
FIG. 3 is an elevational view of the main heating layer of the device, showing the relatively low resistance conductive strips which serve to distribute power, and which are interconnected by patches of relatively high resistance conductive material which provide the heating for the mirror.
Figure 4:
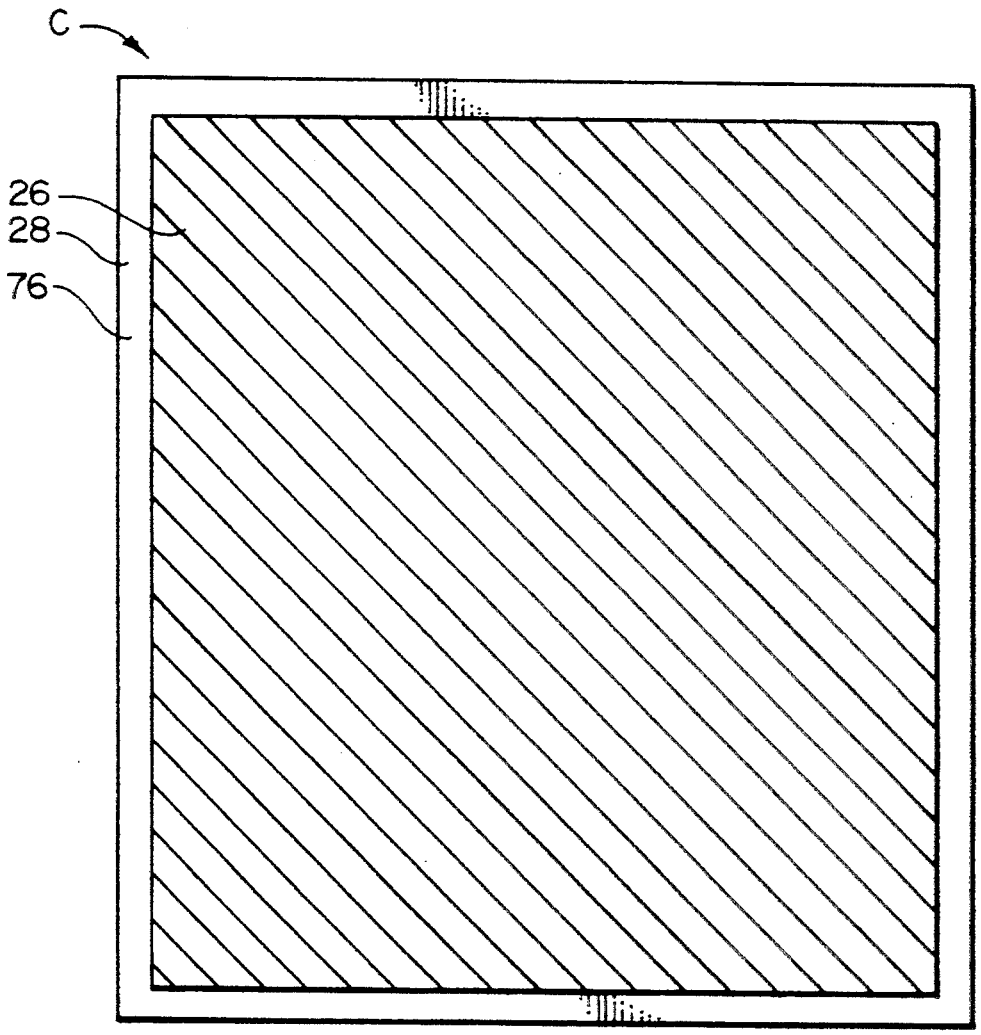
FIG. 4 is an elevational view of the electrostatic shielding layer which is positioned between the heating layer shown FIG. 3 and the back side of the mirror, so as to eliminate the possibility of an electrostatic charge developing.

Having provided an overview of the present invention, the construction of the pad assembly 10 will now be described in greater detail. Reference will be made to FIGS. 2–4, which show the three main subassemblies, looking from the rearward side of the pad; as was noted above, the "core" of the pad assembly is the heating layer B, this being particularly shown in FIG. 3.

i. Insulating Film

The supporting substrate for the heating element layer is provided by the sheet of insulating film 24. Inasmuch as this material is essentially identical to that used for insulating layer 28, this will be described here in detail.

Polyester film is generally preferred for this layer, inasmuch as this exhibits good electrical properties and is relatively inexpensive. Other desirable characteristics include toughness, high temperature durability, good heat stability for drying in ovens during manufacture, good dimensional stability, and high dielectric strength. A polyester film which has been found to be eminently suitable for use in the present invention is 5 mil DuPont A Mylar TM, available from DuPont, Wilmington, Del. This material posses an insulative value of about 3000–5000 V per mil, is suitable for continuous operation at temperatures up to about 150° C., and exhibits excellent resistance to most chemicals. Other suitable Mylar TM films available from DuPont include DuPont D, EL, and MO, the last two exhibiting exceptionally high dielectric strength and high temperature durability. Suitable polyester films are available from various other manufacturers, including Hostaphan TM 5000 (Hoechst Celanese, Greer, S.C.), Melinex TM 427 (ICI, Hopewell, Va.), and Valox TM FR1 (General Electric, Pittsfield, Mass.).

Although polyester film is generally preferred on grounds of economy, polycarbonate sheeting may be used in place of polyester for one or more of the insulating layers. For example, in the embodiment which is illustrated, a 10 mil sheet of this material is used for the back covering 14, owing to its durability and fire resistance. Polycarbonates typically exhibit higher working temperatures and are more fire resistant than the polyester films. Their resistance to chemical attack is also good, although not quite as great as that of the polyesters. Polycarbonate sheeting suitable for use in the present invention includes Lexan TM FR700 (General Electric, Pittsfield, Mass.), Makrofol TM 1005/16-2 and Makrofol TM PCVM 6000-112 (Mobay Corporation, Pittsburg, Pa.), and Polycarbonate DX-3 (ICI Films, Hopeville, Va.).

Epoxy glass laminates also provide excellent insulating layers, although these tend to be relatively expensive; examples include FR4 Epoxy Glass Laminate (General Electric, Coshocton, Ohio), and G-10 Black Industrial Laminate (Westinghouse, Hampton, S.C.). Other suitable insulating films include those available under the tradenames Ultem TM and Kapton TM (General Electric, Pittsfield, Mass.). Still other suitable insulation materials will occur to those skilled in the art.

Preferably, the insulating layers are at least 3 mils thick, with the range of suitable thicknesses being from about 3–30 mils. A 5 mil thickness is generally preferred, because it is strong, easy to screen, and widely available.

ii. High Resistance Conductive Coating

The continuous, relatively high resistance conductive layer 20 (see FIG. 3) is applied over insulating film 24, the resistive layer being the element which provides uniform heat to defog the mirror. Inasmuch as this material is also used to form the high resistance conductive layer 26 of the electrostatic shield, it will be described here in detail.

A suitable resistive coating material is a conductive screen printable ink consisting of finely divided graphite particles dispersed in a thermoplastic resin. Examples of suitable materials of this type include 435A and 440A Linear Resistance Polymers Thick Film Ink, manufactured by Olin Hunt Conductive Materials, Ontario, Calif., and Electrodag TM 423SS and Electrodag TM SS2410, manufactured by Acheson Colloids Company, Port Huron, Mich.

The resistance of screen printable conductive ink is rated in terms of ohms/square. For a particular ink at a particular thickness, the resistance of the square will always be the same, whatever the size of the square. For example, a 1"×1" square will measure the same as a 20"×20" square. By mixing two inks of different resistance values in the proper ratios, the desired resistance rating can be achieved. For example, by mixing the Electrodag TM 423SS material noted above (50 ohms/sq @1 mil) with SS2410 insulating ink, a range of 50 ohms–50K ohms/sq @1 mil can be provided. Similarly, the Olin Hunt 435A (500 ohms/sq), can be mixed with the Olin Hunt 440A (30 ohms/sq) to achieve the desired resistance. Resistance can also be adjusted by controlling the thickness of the ink layer; as a rule, screening a particular ink thinner results in a higher resistance.

The resistivity of layer 20 is selected depending upon the following factors: the wattage per square foot which is desired, the distance between distribution and return conductors, and the voltage which is to be applied. For example, the square footage involved can be determined from the spacing between the distribution/-return conductors, and this can be related to the desired wattage per square foot to calculate the actual wattage required (w); this, in turn, can be used to determine the needed resistance, using the relationship $R=E^2/w$.

A wattage of 34 watts/sq ft has been found particularly suitable for rapid clearing of fogging; wattages upwards of 80 watts/sq ft have been found satisfactory, and a minimum of about 10 watts per square foot is needed for adequate performance. This requires a material resistivity of approximately 1K ohm/sq, given a 10-inch spacing between the distribution and return conductors, and a typical material thickness of about $\frac{1}{2}$ to 1 mil. These requirements are not exacting, and can vary considerably while still achieving satisfactory results.

The high resistance conductive coating is preferably deposited on the Mylar TM sheet (or other insulative substrate) by screen printing. The material is then cured by heating in an oven, at a temperature of about 180°–200° F. when using the preferred materials described above. However, it is worth noting that if a glass epoxy laminate has been selected for the substrate, very high curing heats may be employed, which makes two part thermal-set inks an option for the resistive coating. Also, for lower temperature materials, suitable UV-cure graphite inks are available for forming the resistive coating.

iii. Low Resistance Conductive Coating

The low resistance, highly conductive coating 22 is applied directly to (i.e., in conductive relationship with) the highly resistive layer 20 to form the power distribution and return conductors.

A suitable material for forming the low resistance, highly conductive coating is a screen printable ink consisting of finely divided silver particles dispersed in a thermoplastic resin. As with the resistive coating discussed above, this material is designed primarily for use in flexible circuitry. A suitable example is Owen Hunt 725A Advanced Polymer Thick Film Silver Conductor, available from Olin Hunt Conductive Materials; the resistance of this material is less than 0.015 ohms/sq @1 mil. In addition to the Olin Hunt material, other suitable screen printable highly conductive inks include Electrodag TM 477SSRFU, manufactured by Acheson Colloids.

As noted above, the low resistance conductive material is applied directly to the underlying resistive coating, and essentially serves to form "bus bars" for distributing power to the high resistance conductive graphite layer. Accordingly, the highly conductive layer 22 is formed as first and second thin, continuous strips 60*a*, 60*b* (see FIG. 3), and the copper contacts 36, 38 are adhesively mounted to the two silver strips for connection to the 115 VAC and neutral leads of the power source. An opening or port 66 through the insulating sheet is provided beneath neutral contact strip 38, to enable the neutral contact to bear against and establish contact with the high resistance conductive layer of the underlying electrostatic shield. Gaps 68, 70 are maintained between the two leads 60*a*, 60*b* so as to prevent these from shorting. As was noted, the elongate ends of the strips 60*a*, 60*b* form what are essentially bus bars 72*a–c* which contact the high resistance conductive coating 20 at spaced apart distances so as to provide a power distribution and return network; a uniform spacing of about 8–12 inches has been found particularly satisfactory.

A clear border 74 of the polyester sheet is left around the conductive layers 20 and 22 so as to provide perimeter insulation.

c. Electrostatic Shield Layer

A significant part of the present invention has been the discovery of the unexpected source of the tendency of mirrors equipped with continuous heating pads to shock users. For example, it was observed that available devices which use a radiant heating pad mounted to the back of a mirror tend to impart an unpleasant shock when touched along the edges, especially by a person standing barefoot on a wet floor or leaning against a metal sink. Voltage leakage would be the expected source of such a problem, but testing revealed that no leakage could be detected between the power cord blades and the silver plating on the back of the mirror. What applicants ultimately determined to be the source of the problem was that the ink on the back of the heating pad was acting essentially as one plate of a capacitor, while the polyester and epoxy coating on the back of the mirror were acting as the dielectric, and the silver-copper plating on the back of the mirror was acting as the second capacitor plate. Thus, when 60 Hz alternating current was applied to the heating pads, this electrostatic field produced coupled energy through the layer of polyester next to the silver plating, and if a person touched the edge of the mirror, current flowed to ground.

Applicants solved the above problem by developing the electrostatic shield which is an important feature of the present invention: An extra layer is added adjacent to the mirror plating, and is provided with a high-resistance conductive coating over essentially its entire surface; the conductive layer is connected to the neutral side of the input power, which is at ground potential and so prevents charge buildup across the shield layer. It will be understood that, having recognized the source of the shock problem, this could also be eliminated by building an insulating frame around the edge of the mirror assembly, or by removing the plating from the border of the mirror, so as to eliminate possible electrical contact with the conductor. However, the electrostatic shield of the present invention avoids the need to make such modifications, and permits the assembly to be mounted on standard mirror stock, or retrofitted to an existing mirror.

In the embodiment which is illustrated, the electrostatic shield is represnted by the subassembly C (see FIG. 4). As was noted above, the primary element of the electrostatic shield is the relatively high resistance conductive layer 26 which is printed on insulating layer 28. The conductive layer is continuous across the entire surface of the sheet, but leaving a clear border 76 along the edges for perimeter insulation. The resistive coating is essentially identical to that of layer 20 described above, this being approximately 0.4 mils thick to provide an actual resistance of approximately 1200 ohms/sq. The precise resistance is not critical, as the electrostatic shield is only connected to the neutral power lead, which is at ground potential; the only current layer 26 carries is that generated by the electrostatic field, and this will generally be only a few milliamps (approximately 12 milliamps maximum).

d. Back Cover Layer

The back covering (A) of the pad assembly is shown in FIG. 2. As was noted above, the back covering 14 is preferably provided by a relatively thick (e.g., 10 mil) sheet of polycarbonate material, although polyester film or other suitable insulation may be used. This may be overlain by a layer of reflective material 18, which may be provided by a shiny coating on the outer surface of the back covering, or may be a separate sheet of material. Preferably, the reflective coating is non-metallic, so as to avoid electrostatic coupling. The reflective material serves to reflect heat back towards the mirror, increasing the efficiency of the heating pad; this layer may be omitted in some embodiments. Also, in some embodiments, an extra layer of insulation (e.g., $\frac{1}{8}$-inch styrofoam) may be applied behind the reflective layer or to the backing to keep heat away from the wall behind the mirror.

The back covering layer also incorporates the power connector patch 34. As was noted above, this includes an strain relief cap 50 having a Y-shaped channel in which the leads of the power cord are held; the cap may suitably be formed of $\frac{1}{4}$-inch thick polycarbonate or other, preferably fire resistant plastic, with the channels grooved or molded into its underside; a $1\frac{1}{4}'' \times 2\frac{1}{4}'' \times \frac{1}{4}''$ block of polycarbonate material has been found suitable, as have molded or poured plastics.

The strain relief cap, in turn, is mounted to the rectangular patch 54 which provides anchorage to back covering 14. The purpose of the patch is to strengthen the strain relief, and also to protect the underlying heating pad from the aggressive epoxy adhesive which is used to bond the cap. It has been found suitable to form patch 54 of a $6'' \times 6''$ sheet of 30 mil polycarbonate, bonded to the back covering using a suitable adhesive; other suitable materials include, for example 1//32" epoxy laminate such as Westinghouse G10 Black. A strain relief assembly constructed in accordance with the foregoing has successfully demonstrated the ability to withstand a 35 lb. pull in both vertical and horizontal directions. The strain relief cap will also easily fit within a concealed outlet box, such as a clock outlet, behind the mirror, permitting flat mounting of the assembly against a wall.

As was noted above, the copper strip contacts 36, 38 establish contact between the power source and the conductive layers of the heating and electrostatic shield subassemblies. The contacts are bonded to the silver bus bar strips on the heating layer, and (through port 66) to the resistive layer 26 on the electrostatic shield, using a conductive adhesive, epoxy or other suitable adhesive; for example, Olin Hunt 620A and B two-pasrt adhesive has been found suitable for this application, as has Dynamax conductive silver adhesive.

e. Adhesive

As was noted above, the pad assembly 10 is mounted to the back of the mirror 12 using a suitable adhesive; similarly (as will be described below), the pad assembly itself is assembled using an adhesive applied to the layers of insulation. A principal factor in selecting a suitable adhesive is its ability to withstand long-term exposure to heat: Average operating temperatures are about 110° F. (30°–40° above room temperature), and it is possible for the pad and mirror to reach temperatures of about 160° F. in ambient temperatures of 120° F.; many unsuitable adhesives tend to weaken and deteriorate at these elevated temperatures. Another factor is the tendency of the solvents in some adhesives to react with the conductive inks to affect their resistive values, and this may need to be taken into consideration.

A contact adhesive which has been found eminently suitable for purposes of the present invention is Macfilm TM IF-2012 available from Morgan Adhesives of Stow, Ohio. A layer of this adhesive about 2–5 mils thick is stable to temperatures of about 300° F., and provides a peel strength of about 5–6 pounds per square inch; moreover, this material does not contain any chemicals which attack the conductive inks.

Many other suitable adhesives are available, including the following examples: TA1212-Duramark Company, Minneapolis, Minn.; 3M468 and F-9460PC-3M, St. Paul, Minn.; Fast Tape TM 1112HX-Avery International, Plainesville, Ohio; V-23 Adhesive-Flexcon of Spencer, Mass.

f. Construction Of Example Embodiment

An example embodiment of a device in accordance with the present invention may be fabricated by the following procedure:

(1) Cut two sheets of 5 mil polyester material (DuPont A) and one sheet of 10 mil polycarbonate material (Lexan TM 700 Black) to the desired size, usually that of the mirror itself.

(2) Screen print the first polyester sheet with conductive screen printable graphite ink in thermoplastic resin (Olin Hunt 435A). The entire sheet is covered, except for a $\frac{1}{2}$–$\frac{3}{4}$ inch border for insulation. The ink is dried in an oven at approximately 180°–200° F. for about 10–20 minutes. This forms the electrostatic shield portion of the assembly.

(3) The second polyester sheet is screen printed with a mixture of conductive screen printable graphite inks in a thermoplastic resin. The mixture (Olin Hunt 435A and Olin Hunt 440A) is adjusted to obtain the desired resistance rating in ohms/sq. Using 9-inch spacing between the power distribution strips, a resistance of approximately 800 ohms/sq. with a thickness of an additional 0.4 mil is typical. The ink is oven dried at about 180°–200° F. for approximately 10–20 minutes. Next the highly conductive silver ink in thermoplastic resin (Olin Hunt 725A) is screen printed over the graphite ink on the same sheet to form the power distribution network for the resistive graphite layer. A $\frac{1}{2}$–$\frac{3}{4}$ inch clear border is left around the perimeter of the silver and graphite inks to provide insulation. The silver ink is oven dried, again at approximately 180°–200° F. for 10–20 minutes. This completes the heating layer portion of the assembly.

(4) A hole is cut in the 10 mil black polycarbonate back covering sheet to permit penetration by the upturned tabs on the copper strips.

(5) The transfer laminating adhesive (Morgan Adhesives Macfilm IF-2012 2 mil) is typically supplied on rolls with a release liner. To apply this, the transfer adhesive is cut to the approximate size and applied to the back of the polycarbonate and polyester sheets. A roller is employed to smooth down the adhesive and prevent air entrapment. The film is then left in stacks for approximately 24 hours to ensure complete adhesion.

(6) The release liner is peeled from the back of the heating layer (B), and then the heating layer is bonded to the electrostatic shield layer (A). A roller again is used to press the bond together and prevent air entrapment.

(7) Two 3 mil copper strips about $\frac{1}{2}$–$\frac{3}{4}$ inch wide by 3–5 inches long (depending on pad size) are bonded to the silver power distribution strips at the connection pad areas. A conductive two-part silver adhesive (Olin Hunt 620A and 620B) is used. The copper strip which connects the neutral lead also extends across the port formed in the polyester insulation of the heating layer, allowing contact with the underlying electrostatic shield. The two-part silver adhesive is oven dried at 180°–200° F. for 10–20 minutes.

(8) The release liner is peeled from the back of the 10 mil polycarbonate back covering, which is then adhered to the heating layer using a roller. The copper strips protrude through the hole or holes cut in the polycarbonate sheet.

(9) A 6"×6" 30 mil polycarbonate sheet (Lexan FR700) is bonded over the area where the two copper strips protrude, using the transfer laminating adhesive. This is also provided with a hole or holes for the copper strips.

(10) The ends of the power cord are soldered to the copper strips, with care being taken to ensure that the neutral blade is connected to the neutral strip.

(11) The strain relief cap with the Y-shaped channel is bonded over the cord and to the 30 mil polycarbonate patch using a two-part methacrylic adhesive (e.g., Plexus TM MA320, available from ITW Devcon). For cord connected models, the cord is preferably 18 AWG or heavier SPT-2 with a polarized plug. Hard wired models are preferably provided with two 18 AWG or heavier wires rated at 150 volts and 105° C. For hard wired models, the strain relief patch is normally mounted in an upper corner of the assembly, so that the cord extends downwardly towards the middle of the pad, and the cap is preferably sized small enough to fit within a receptacle box behind the mirror.

g. Serpentine Conductive Layer

Figure 5:
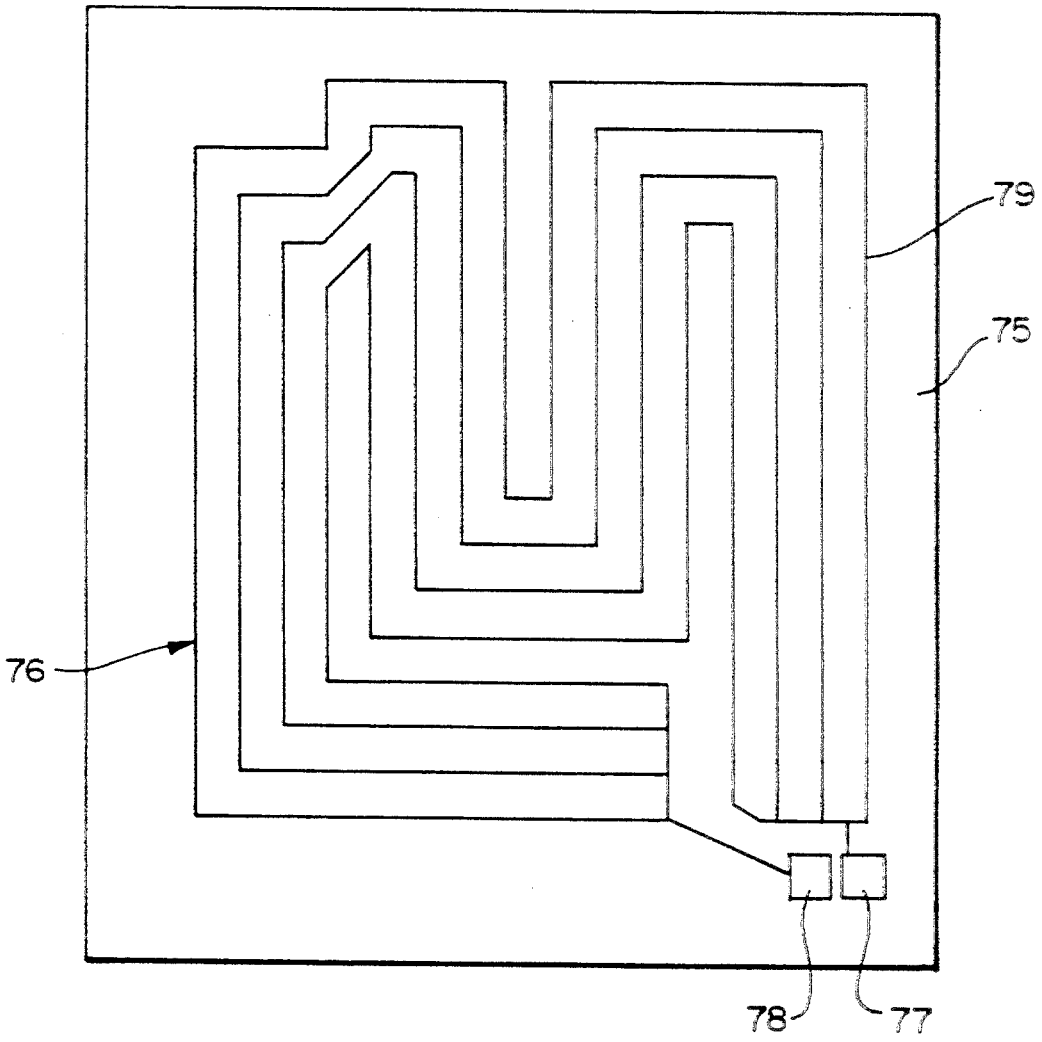
FIG. 5 is an elevational view of a second embodiment of heating layer, in which the conductive material is formed as a serpentine element.

The exemplary embodiments described above employ a heating assembly in which the primary heating element is provided by more-or-less continuous two-dimensional sheets of high resistance conductive ink. FIG. 5 illustrates a heating layer which corresponds to the heating subassembly (B) described above, but in which the heating element is provided with a somewhat different configuration. As can seen, there is again an insulating substrate 75 (e.g., polyester film) on which a conductive layer 76 of ink is printed, and hot and neutral contacts 78, 77. However, in this embodiment, the conductive layer is configured to provide a fine, serpentine strip 79 which is continuous from hot to neutral. The resistivity of the continuous conductor can be selected to provide the desired heating; while this arrangement may not produce the same uniformity of heating as the versions described above, it may be preferred in some cases owing to the savings in the amount of conductive ink required.

h. Power Controller

Several different types of controllers may be employed to supply power to the leads of the pad assembly: Examples of these are illustrated in FIGS. 6A–6C.

Figure 6A:
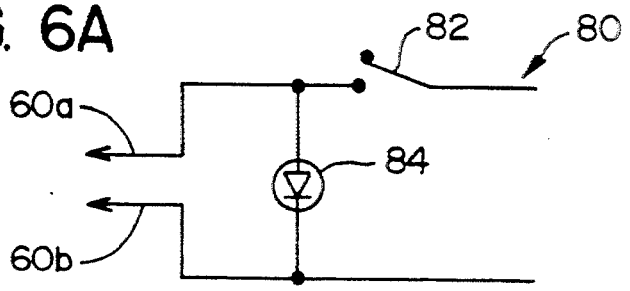
FIGS. 6A–6C are schematic views showing, respectively, first, second, and third embodiments of controllers which supply power to the low resistance conductive strips of the heating layer.

FIG. 6A shows a basic controller 80 with a simple on/off switch 82 which is closed to supply power to leads 60A, 60B; switch 82 may be suitably provided by a conventional well-mounted switch. A light emitting diode 84 indicates power on.

Figure 6B:
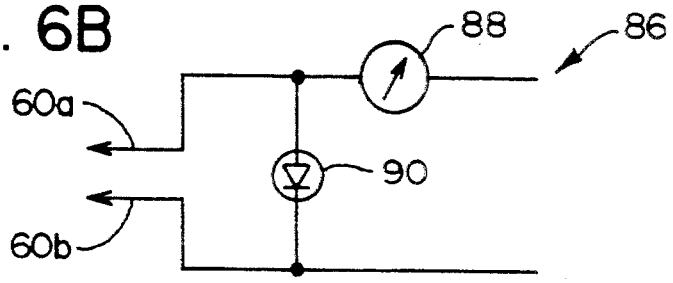

FIG. 6B illustrates a controller 86 in which the on/off switch is provided by a timer 88 which turns the heating assembly off after a predetermined time. A conventional fan time switch may be employed for this purpose. Again, a light emitting diode 90 is included to indicate power on.

Figure 6C:
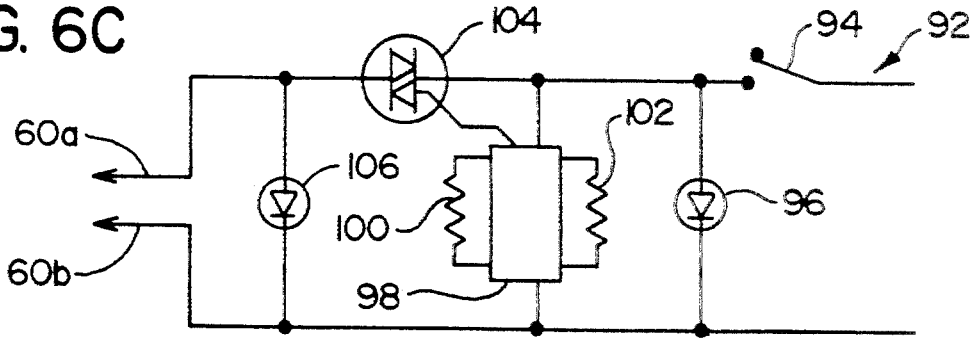

FIG. 6C illustrates a power controller 92 which incorporates a heat differential control to maximize energy efficiency. Only a relatively small differential between mirror temperature and room temperature needs to be maintained to keep the mirror defogged, for example, about 3°–5° F.; accordingly, the controller which is shown in FIG. 6C measures the difference between mirror temperature and room temperature, so as to maintain the differential at the necessary minimum. Switch 94 connects the controller to the power source, and an LED 96 is again provided to indicate power on. A heat differential controller 98 is mounted across the leads, and detects the inputs from a mirror heat thermistor 100 and a room heat thermistor 102; if the mirror is not 3°–5° F. higher than room temperature, diac 104 is gated on, supplying power to leads 60A, 60B, and a mirror heat LED 106 indicates that power is being supplied to the heating assembly. When the temperature differential exceeds the 3°–5° F. minimum, power is gated off; mirror heat is thus cycled on and off on a continuous basis by the differential control 98 so as to maintain the minimum differential needed to prevent fogging. If desired, the temperature differenteial may be adjusted to more or less than the 3°–5° range, as, for example, if the mirror is to be used as a room heater. Furthermore, a timed cycle may be included, during which the mirror is initially heated significantly (e.g., 30°–40° F.) above room temperature for quick clearing, before dropping to the maintenance differential.

i. Additional Embodiments And Features

The foregoing description has centered on an exemplary embodiment wherein the device is manufactured by first assembling the layered heating pad, and then adhering this to the back side of the mirror stock. However, it will be understood that this process is subject to many variations; for example, the entire assembly may be built up, layer-upon-layer, beginning with installing the insulation on the back of the mirror. As another example, the layer of low resistance conductive ink may be deposited beneath the layer of high resistance conductive material, rather than on top of it as shown. Also, in some embodiments, the pad may be sold separately, for example, with an adhesive surface covered with release paper, so that the assembly can be mounted on the mirror stock locally and installed, as by a local contractor, or to the back of an existing mirror on a retrofit basis; this is particularly advantageous in many situations since it avoids excessive shipping costs.

Also, the assembly may include layers in addition to those shown in the illustrated embodiment, or some of those shown may be deleted. For example, the reflective layer 18 may be eliminated in some embodiments. Moreover, many variations to the materials used and the structures shown will occur to those skilled in the art.

Furthermore, it will be recognized that the device may be configured to serve one or more useful purposes in addition to defogging the mirror surface. For example, it has been found that the device is quite effective in keeping a bathroom warm and dry, and it heats a person standing in front of it by radiant heat; thus, the structure may be especially configured to act as a radiant heater, as by providing for higher thermal output and/or incorporation a thermostat. As another example, the device may be used as a towel warmer: A heating pad can be applied to relatively heavy mirror stock (e.g., ⅜-inch thick), which then is mounted a spaced distance from the wall (as on finished 2×4 material) so that towels can be draped over the top of the mirror and kept warm until ready for use.

From the foregoing, it will be understood that the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A fog-free mirror assembly comprising, in combination:

a mirror having a back surface with a conductive metallic reflective coating formed thereon;

a generally planar electric heating element mounted to said back surface of said mirror so as to extend substantially parallel to said metallic reflective coating formed thereon, said heating element being spaced apart from said reflective coating by a distance which is sufficiently small as to allow capacitive coupling to occur between said element and said coating;

a generally planar electrostatic shield mountable intermediate said electric heating element and said metallic reflective coating on said mirror, said electrostatic shield comprising a layer of conductive material which extends intermediate said element and said coating;

means for connecting said electric heating element to an alternating current power supply having a hot lead and a neutral lead; and means for connecting said layer of conductive material in said electrostatic shield to said neutral lead of said power supply so as to feed a constant capacitively coupled current to said neutral lead, so that said shield prevents development of an electrostatic potential due to said capacitive coupling between said electric heating element and said reflective coating on said mirror assembly.

2. The assembly of claim 1, wherein said layer of conductive material in said electrostatic shield comprises a layer of relatively high resistance conductive material.

3. The assembly of claim 2, wherein said electric heating element comprises:

a second layer of relatively high resistance conductive material connected across said leads of said alternating current power supply so that said second layer becomes heated thereby.

4. The assembly of claim 3, wherein said means for applying voltage across said second layer of relatively high resistance conductive material comprises:

a layer of relatively low resistance conductive material in contact with said second layer;

said layer of relatively low resistance conductive material being formed as first and second contact strips, said contact strips being connected to said hot and neutral leads of said alternating current power supply and being spaced apart from one another so that said current flows through said second layer of high resistance conductive material.

5. The assembly of claim 4, wherein said layer of high resistance conductive material in said electrostatic shield comprises:

a layer of high resistance conductive ink deposited on a first layer of insulating material.

6. The assembly of claim 5, wherein said second layer of high resistance conductive material comprises:

a layer of high resistance conductive ink deposited on a second layer of insulating material.

7. The assembly of claim 6, wherein said layer of low resistance conductive material comprises:

a layer of low resistance conductive ink deposited in contact with said layer of high resistance conductive ink on said second layer of insulating material.

8. The assembly of claim 7, further comprising:

means for bonding said heating element to said electrostatic shield so that said layer of conductive material in said shield is sandwiched between said first and second layers of insulating material, and so that a surface of said first layer of insulating material which is free of said high resistance conductive material is mountable to said back surface of said mirror.

9. The assembly of claim 8, further comprising:

a back cover of insulating material mounted over said layers of low and high resistance conductive material on said second layer of insulation, so that said conductive layers of said heating element are sandwiched between said back cover and said second layer of insulating material.

10. The assembly of claim 6, wherein said first and second layer of insulating material comprise, respectively, first and second sheets of polyester insulating film.

11. The assembly of claim 10, wherein said layers of conductive ink are screen printed layers deposited on said sheets of polyester insulating film.

12. The assembly of claim 9, further comprising:

first and second metallic contacts bonded to said contact strips of said layer of low resistance conductive material in said electric heating element;

said metallic contacts having outwardly extending tab portions which protrude through openings formed in said back cover, for attachment to said hot and neutral leads of said power supply.

13. The assembly of claim 12, wherein said means for connecting said layer of high resistance conductive ink in said electrostatic shield to said neutral lead of said power supply comprises:

a portion of said second layer of insulation having an opening formed therethrough so a to expose said layer of high resistance conductive ink on said electrostatic shield which underlies said heating element;

said second metallic contact being positioned so as to extend across said opening in said second layer of installation, so that said second contact bears against said exposed layer of high resistance conductive ink in electrical contact therewith.

14. The assembly of claim 12, wherein said hot and neutral leads attached to said protruding tab portions of said metallic contacts are hot and neutral leads of a power cord.

15. The assembly of claim 14, further comprising:

a strain relief for holding said leads of said power cord in attachment with said tab portions against pulling forces exerted on said cord.

16. The assembly of claim 15, wherein said strain relief comprises:

a strain relief cap mounted to said back cover of said assembly, said cap having a Y-shaped channel formed therein for holding said hot and neutral leads of said power cord, and first and second recesses at ends of said Y-shaped channel for receiving said tab portions which are attached to said leads.

17. The assembly of claim 16, wherein said strain relief further comprises:

a thin, planar patch member, said strain relief cap being mounted generally centrally to an outer surface of said patch member so that edges thereof extend outwardly around said cap, and an inner surface of said patch member being mounted adhesively to said back cover of said device so as to support said strain relief cap thereon.

18. A method for heating a mirror so as to prevent the formation of fog thereon, said method of comprising the steps of:

providing a mirror having a back surface with a conductive metallic reflective coating formed thereon;

mounting a generally planar electric heating element to said back surface of said mirror adjacent to said reflective coating thereon, so that said heating element extends substantially parallel to said metallic reflective coating and is spaced apart therefrom by a distance which is sufficiently small as to allow capacitive coupling to occur between said element and said coating;

mounting a generally planar electrostatic shield intermediate said electric heating element and said metallic reflective coating on said mirror, said electrostatic shield comprising a layer of conductive material which extends intermediate said element and said coating;

connecting said electric heating element to an alternating current power supply having a hot lead and a neutral lead; and connecting said electrostatic shield to said neutral lead of said power supply so as to feed a constant capacitively coupled current to said neutral lead, so that said shield prevents development of an electrostatic potential due to capacitive coupling between said electric heating element and said reflective coating on said mirror.

19. An apparatus for heating a mirror having a back surface with a conductive metallic reflective coating formed thereon, said apparatus comprising:

a generally planar electric heating element;

a generally planar electrostatic shield comprising a layer of conductive material;

means for mounting said heating element to said back surface of said mirror so that said layer of conductive material in said planar electrostatic shield is sandwiched intermediate said planar heating element and said reflective coating on said back surface of said mirror, and so that said heating element extends substantially parallel to said metallic reflective coating and is spaced apart therefrom by a distance which is sufficiently small as to allow capacitive coupling to occur between said element and said coating;

means for connecting said electric heating element to an alternating current power supply having a hot lead and a neutral lead; and means for connecting said layer of conductive material in said electrostatic shield to said neutral lead of said power supply so as to feed a constant capacitively coupled current to said neutral lead, so that said shield prevents development of an electrostatic potential due to capacitive coupling between said electric heating element and said reflective coating on said back surface of said mirror.

20. The apparatus of claim 19, wherein said layer of conductive material in said electrostatic shield comprises a layer of relatively high resistance conductive material.

21. The apparatus of claim 20, wherein said electric heating element comprises:

a second layer of relative high resistance conductive material; and means for applying voltage across said second layer of relatively high resistance conductive material so that said layer becomes heated thereby.

22. The apparatus of claim 21, wherein said means for applying voltage across said second layer of relatively high resistance conductive material comprises:

a layer of relatively low resistance conductive material in contact with said second layer;

said layer of relatively low resistance conductive material being formed as first and second contact strips, said contact strips being connected to said leads of said power source and being spaced apart from one another so that said current flows through said second layer of high resistance conductive material.

23. The apparatus of claim 21, wherein said means for mounting said heating elements to said back surface of said mirror comprises:

means for mounting said electric heating element to a first side of said planar electrostatic shield; and a layer of adhesive for mounting a second side of said planar electrostatic shield to said reflective coating on said back surface of said mirror.

24. The apparatus of claim 23, wherein said means for mounting said electric heating element to said first side of said planar electrostatic shield comprises:

a layer of adhesive for mounting said planar heating element to said first side of said shield.

25. An electric heating assembly for warming a mirror so as to prevent the formation of fog thereon, without developing an electrical charge on a conductive metallic reflective coating on a back surface of said mirror, said electric heating assembly being adapted for use in an AC electrical circuit which is protected by a grounded-fault circuit-interrupter, said assembly comprising:

a generally planar heating element;

a generally planar electrostatic shield comprising a layer of conductive material;

means for mounting said heating element to said back surface of said mirror so that said layer of conductive material in said electrostatic shield is sandwiched intermediate said heating element and said reflective coating on said back surface of said mirror;

means for connecting said planar heating element to said electrical circuit which is protected by said grounded-fault circuit-interrupter; and means for connecting said layer of conductive material in said electrostatic shield to a neutral lead of said AC electrical circuit which is at ground potential, so that a capacitively coupled current which is generated by a magnetic field between said heating element and said coating on said mirror is continuously fed by said shield to said neutral lead of said circuit, so as to prevent development of an electrostatic potential due to capacitive coupling between said heating element and said coating on said mirror without causing actuation of said grounded-fault circuit-interrupter which would interrupt said circuit.

* * * * *